US010113257B2

(12) United States Patent
Luo

(10) Patent No.: US 10,113,257 B2
(45) Date of Patent: Oct. 30, 2018

(54) MULTI-NEEDLE BAR MODULE FOR SEWING MACHINES

(71) Applicant: NINGBO SUPREME ELECTRONIC MACHINERY CO., LTD., Ningbo, Zhejiang Province (CN)

(72) Inventor: Qian Luo, Ningbo (CN)

(73) Assignee: NINGBO SUPREME ELECTRONIC MACHINERY CO., LTD., Ningbo (CN)

( * ) Notice: Subject to any disclaimer, the term of this patent is extended or adjusted under 35 U.S.C. 154(b) by 136 days.

(21) Appl. No.: 14/382,213

(22) PCT Filed: Apr. 17, 2014

(86) PCT No.: PCT/CN2014/075543

§ 371 (c)(1),
(2) Date: Aug. 29, 2014

(87) PCT Pub. No.: WO2015/003515

PCT Pub. Date: Jan. 15, 2015

(65) Prior Publication Data

US 2016/0237606 A1 Aug. 18, 2016

(30) Foreign Application Priority Data

Jul. 12, 2013 (CN) ..... 2013 1 0293019

(51) Int. Cl.
*D05B 55/10* (2006.01)
*D05C 11/04* (2006.01)

(52) U.S. Cl.
CPC ..... *D05B 55/10* (2013.01); *D05C 11/04* (2013.01)

(58) Field of Classification Search
CPC ..... D05B 55/10; D05C 11/04
(Continued)

(56) References Cited

U.S. PATENT DOCUMENTS 1,764,865 A * 6/1930 Barber ..... D05B 55/10 112/226
2,563,916 A * 8/1951 Brussell ..... D05B 3/02 112/163

(Continued)

*Primary Examiner* — Danny Worrell
*Assistant Examiner* — Jocelyn Bravo
(74) *Attorney, Agent, or Firm* — Jiwen Chen

(57) ABSTRACT

The present invention discloses a multi-needle bar module for sewing machines. Such a multi-needle bar module may be additionally mounted on the existing sewing machines, so that the existing sewing machines may be easily retrofitted into multi-needle bar sewing machines. The multi-needle bar module is not limited to a two-needle bar structure, and may be assembled with three, four or more needle bars according to actual requirements, solving the problem that both the single-needle bar sewing machines and the two-needle-bar sewing machines require manual change of threads in the process of sewing a pattern due to insufficient color varieties of the upper threads. The multi-needle-bar module guides each needle bar via the first horizontal guideway and the second horizontal guideway, and feeds a specific needle bar into the neck of the needle bar driving block via the driving mechanism. Such a multi-needle bar module has the advantages of simple structure and automatic control.

11 Claims, 3 Drawing Sheets

(58) Field of Classification Search
USPC ..... 112/163
See application file for complete search history.

(56) References Cited

U.S. PATENT DOCUMENTS 2,973,732 A * 3/1961 Hayes ..... D05B 1/10 112/163
4,103,562 A * 8/1978 Boser ..... D05B 35/064 74/527
4,498,405 A * 2/1985 Hanyu ..... D05B 1/12 112/163
4,531,467 A * 7/1985 Golia, Jr. ..... D05C 11/16 112/155
4,582,007 A * 4/1986 Yamazawa ..... D05B 55/16 112/163
4,719,865 A * 1/1988 Yokoe ..... D05B 49/02 112/163
4,996,932 A * 3/1991 Nishimaki ..... D05B 3/04 112/157
5,339,757 A * 8/1994 Nakano ..... D05B 55/14 112/163
5,341,755 A * 8/1994 Kawasaki ..... D05B 33/00 112/163
5,390,613 A * 2/1995 Shibata ..... D05C 11/16 112/163
5,474,001 A * 12/1995 Tajima ..... D05C 5/02 112/102.5
5,655,471 A * 8/1997 Tajima ..... D05B 49/00 112/163
5,957,069 A * 9/1999 Shibata ..... D05C 3/02 112/155
6,170,415 B1 * 1/2001 Inoue ..... D05B 55/10 112/163
6,332,419 B1 * 12/2001 Ku ..... D05B 1/08 112/163
8,096,251 B2 * 1/2012 Suzuki ..... D05B 19/14 112/155
2004/0055521 A1 * 3/2004 Katou ..... D05B 11/00 112/273
2007/0101914 A1 * 5/2007 Suzuki ..... D05B 55/10 112/221
2008/0271659 A1 * 11/2008 Hsien-Chang ..... D05B 55/02 112/226
2009/0020055 A1 * 1/2009 Hillenbrand ..... D05C 11/04 112/226
2009/0173261 A1 * 7/2009 Tajima ..... D05C 11/16 112/80.43
2009/0314192 A1 * 12/2009 Tajima ..... D05B 57/30 112/163
2010/0000452 A1 * 1/2010 Guerreschi ..... D05B 55/14 112/163
2010/0126396 A1 * 5/2010 Stutznacker ..... D05B 55/10 112/165
2010/0236463 A1 * 9/2010 Fujihara ..... D05B 19/14 112/470.05
2010/0242819 A1 * 9/2010 Fukao ..... D05C 11/16 112/163
2011/0185957 A1 * 8/2011 Fukao ..... D05B 3/02 112/98
2013/0025517 A1 * 1/2013 Fujihara ..... D05C 11/20 112/163

* cited by examiner

MULTI-NEEDLE BAR MODULE FOR SEWING MACHINES

This is a U.S. national stage application of PCT Application No. PCT/CN2014/075543 under 35 U.S.C. 371, filed Apr. 17, 2014 in Chinese, claiming the priority benefit of Chinese Application No. 2013102930195, filed Jul. 12, 2013, which is hereby incorporated by reference.

TECHNICAL FIELD

The present invention relates to a sewing machine, in particular to a multi-needle bar module for sewing machines.

BACKGROUND OF THE INVENTION

The existing sewing machines usually include an upper shaft which drives, through a needle bar driving linkage assembly, one needle bar to move up and down. The needle bar, during the up and down movement, is penetrated through needle holes on a needle plate, so that cloth is sewn by the coordination between the upper threads and the base threads mounted on a base bobbin. With higher requirements of sewing, upper threads of different colors are sometimes required to sew the cloth. Thus, manual change of threads is required during the sewing. This operation is complex, resulting in low efficiency of sewing.

Chinese Utility Model Application No. 201120342948, titled Needle Bar of Two-Needle Sewing Machine and Switching Mechanism Thereof disclosed a needle bar of a two-needle sewing machine and a switching mechanism thereof. This needle bar comprises a hollow needle bar body, the lower end of which is fixedly connected to a needle bar head used for mounting a needle. A reset spring, a first wedge, a second wedge and a switching compression lever are sequentially provided inside the needle bar body. The upper end of the switching compression lever is exposed from the needle bar body. The tip of the first wedge faces downward while the tip of the second wedge faces upward. A first through hole is provided at a position, corresponding to the first wedge, on the side wall of the needle bar body, and a first slider is provided inside the first through hole; and a second through hole is provided at a position, corresponding to the second wedge, on the side wall of the needle bar body, and a second slider is provided inside the second through hole. The switching compression lever comprises a needle bar, a needle bar frame, a needle bar sleeve, a needle bar driving mechanism and a switching compression block, the needle bar sleeve being connected to the needle bar driving mechanism, the needle bar frame being connected to a translation device. The two needle bars in this utility model may be penetrated by two upper threads of different colors. Therefore, a pattern with two colors may be sewn at one time, avoiding changing the threads manually. However, such a two-needle bar structure is complex and has high requirement on the machining precision, resulting in high manufacturing cost. Moreover, manual change of threads is still required when sewing a pattern of three or more colors.

SUMMARY OF THE INVENTION

In view of the status of the prior art as mentioned above, the technical issue of the present invention is to provide a multi-needle bar module for sewing machines. Such a multi-needle bar module may be additionally mounted on the existing sewing machines, so that the sewing machines have a multi-needle bar structure to be convenient to sew a pattern of a plurality of colors.

The following technical solution is employed to solve the technical issue of the present invention: a multi-needle bar module for sewing machines is provided, comprising a mounting plate adapted to a front end of a sewing machine head; the mounting plate is equipped in a sliding manner, via a bracket, with a needle bar mounting frame on which at least two needle bars are distributed spaced apart, the needle bars being in an axial sliding fit with the needle bar mounting frame; the mounting plate is provided with a first horizontal guideway and a second horizontal guideway disposed spaced apart, and a needle bar driving block with a neck is disposed between the first horizontal guideway and the second horizontal guideway; the needle bars are provided with guide members that can be clamped into the first horizontal guideway and the second horizontal guideway; and the needle bar mounting frame clamps, by sliding horizontally, the guide member of any one of the needle bars individually into the neck.

To optimize the technical solution mentioned above, the present invention further comprises the following improved technical solutions.

The needle bar driving block is disposed on a vertical guide shaft in a sliding manner.

The needle bars are fixedly connected with a clamping column on which the guide members are located.

The needle bar mounting frame is provided with a vertical slideway, and the clamping column is provided with a slider in sliding fit with the slideway.

A first guide and a second guide are fixed on the mounting plate at intervals, and the first horizontal guideway is located on the first guide while the second horizontal guideway is located on the second guide.

The bracket is fixed with a guide rail arranged horizontally, and the needle bar mounting frame is connected to the slider on the guide rail.

The bracket is fixedly provided with a driving mechanism for driving the needle bar mounting frame to slide.

The driving mechanism comprises a cylinder unit consisting of at least one cylinder, and the driving rod of the cylinder is connected to the needle bar mounting frame.

The driving mechanism comprises a motor, a gear connected to the motor, and a rack disposed on the needle bar mounting frame and meshed with the gear.

The needle bar mounting frame is provided with three needle bars distributed at intervals, and the cylinder unit consists of two cylinders connected to each other.

Compared with the prior art, the multi-needle bar module for sewing machines provided by the present invention may be additionally mounted on the existing sewing machines, so that the existing sewing machines may be easily retrofitted into multi-needle bar sewing machines. The multi-needle bar module is not limited to a two-needle-bar structure, and may be assembled with three, four or more needle bars according to actual requirements, solving the problem that both the single-needle bar sewing machines and the two-needle bar sewing machines require manual change of threads in the process of sewing a pattern due to insufficient color varieties of the upper threads. The multi-needle bar module guides each needle bar via the first horizontal guideway and the second horizontal guideway, and feeds a specific needle bar into the neck of the needle bar driving block via the driving mechanism. Such a multi-needle bar module has the advantages of simple structure and automatic control.

Figure 1:
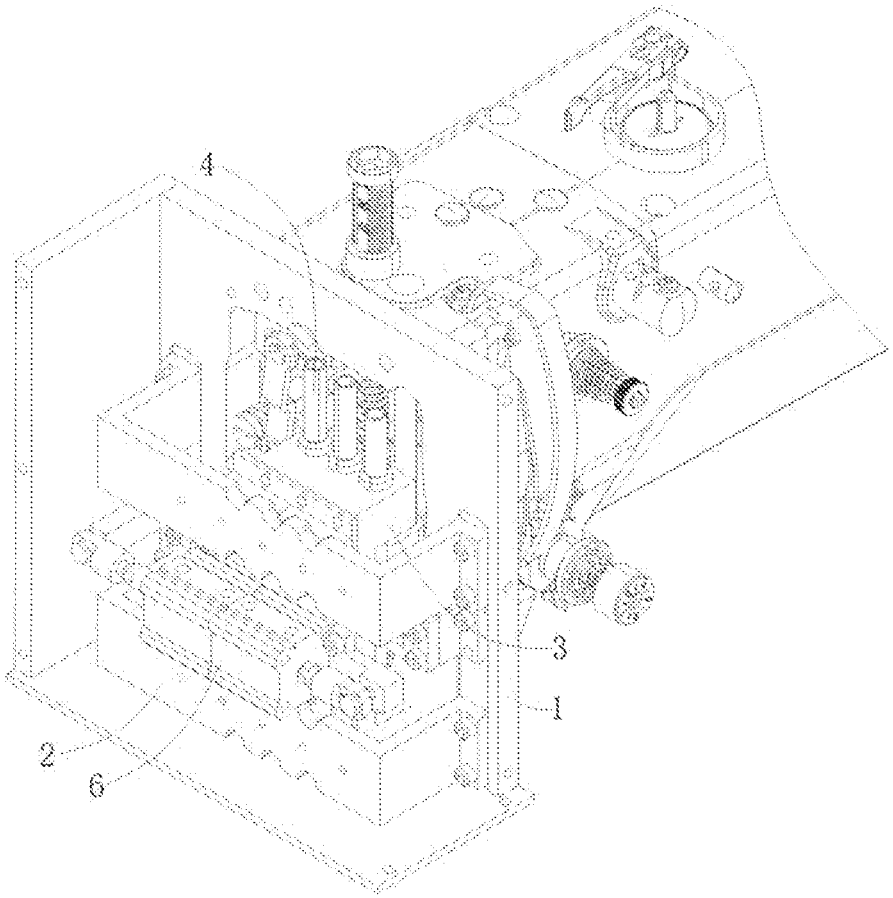
FIG. 1 is a stereoscopic structure diagram of the first embodiment according to the present invention.

The reference numerals in the drawings have the following meanings: 1—Mounting plate; 11—First horizontal guideway; 12—Second horizontal guideway; 13—First guide; 14—Second guide; 2—Bracket; 21—Guide rail; 22—Slider/Sliding block; 3—Needle bar mounting frame; 31—Needle bar sleeve; 4—Needle bar; 41—Clamping column; 41*a*—Guide member; 41*b*—Slider; 42—Needle bar hoop; 5—Needle bar driving block; 5*a*—Neck; 51—Guide shaft; 6—Cylinder unit; 61—First cylinder; 62—second cylinder; 7—Motor; 71—Gear; and 72—Rack.

DETAILED DESCRIPTION OF THE INVENTION

A multi-needle bar module for sewing machines provided by the present invention comprises a mounting plate 1 adapted to a front end of a sewing machine head. The mounting plate 1 is equipped in a sliding manner, via a bracket 2, with a needle bar mounting frame 3 on which at least two needle bars 4 are distributed at intervals. The needle bars 4 are in axial sliding fit with the needle bar mounting frame 3. The mounting plate 1 is provided with a first horizontal guideway 11 and a second horizontal guideway 12 disposed at intervals, and a needle bar driving block 5 with a neck disposed between the first horizontal guideway 11 and the second horizontal guideway 12. The needle bars 4 are provided with guide members 41*a* that can be clamped into the first horizontal guideway 11 and the second horizontal guideway 12. The needle bar mounting frame 3 can clamp, by sliding horizontally, the guide member 41*a* of any one of the needle bars 4 individually into the neck 5*a*.

Figure 2:
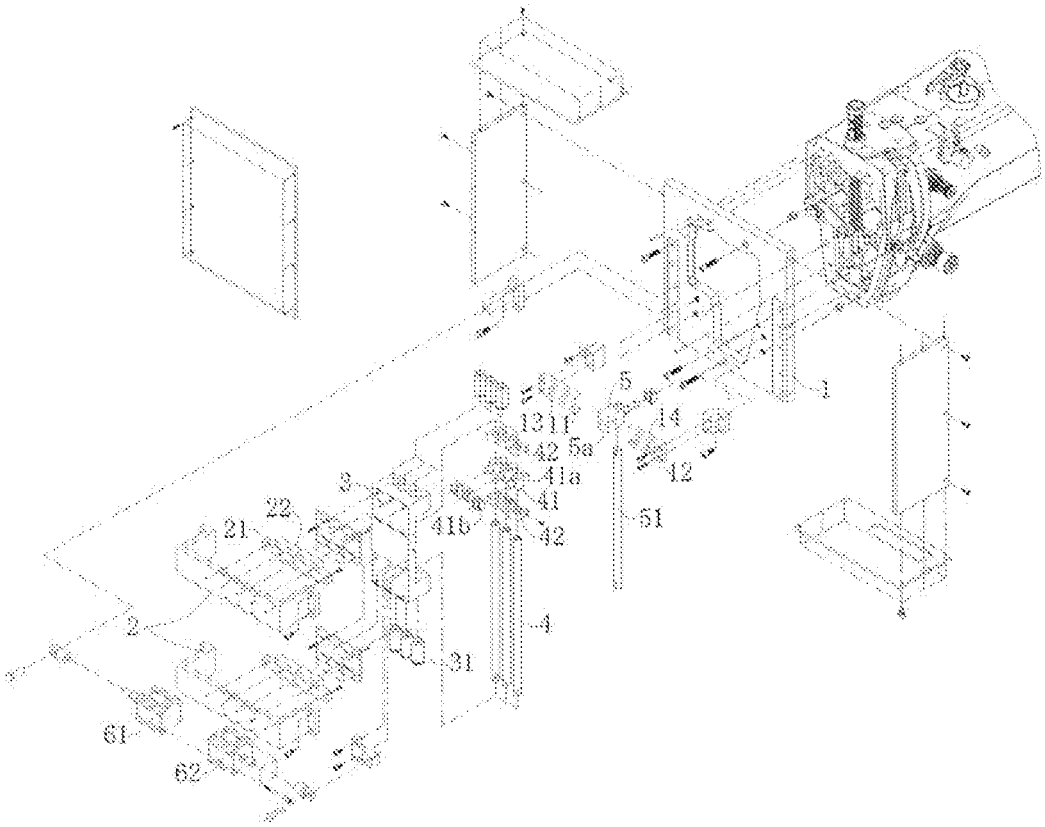
FIG. 2 is an exploded assembly view of FIG. 1.

In the exploded assembly view as shown in FIG. 2, the mounting plate 1 is adapted to the front end of the sewing machine head. An upper shaft and a needle bar driving linkage assembly connected to the upper shaft are disposed inside the machine head.

A first guide 13 and a second guide 14 are fixed on the mounting plate 1 at intervals. The first horizontal guideway 11 is located on the first guide 13 while the second horizontal guideway 12 is located on the second guide 14.

The mounting plate 1 is fixed with a guide shaft 51, and the needle bar driving block 5 is disposed on a vertical guide shaft 51 in a sliding manner. The needle bar driving block 5 is located between the first guide 13 and the second guide 14, and connected to the needle bar driving linkage assembly. The needle bar driving block 5 may be driven, by the upper shaft and the needle bar driving linkage assembly, to move up and down along the guide shaft 51.

In this embodiment, the needle bar mounting frame 3 is provided with three needle bars 4 distributed at intervals. The needle bar mounting frame 3 is provided with needle bar sleeves 31, and the needle bars 4 are in sliding fit with the corresponding needle bar sleeves 31, respectively. Each of the needle bars 4 can individually move up and down with respect to the needle bar mounting frame 3.

Each of the needle bars 4 is fixedly connected with a clamping column 41. Each of the needle bars 4 is fixed with two needle bar hoops 42 through which the clamping column 41 is fixed. The clamping column 41 may be formed integrally with the body of each of the needle bars 4.

The guide members 41*a* are located on the clamping column 41, so that the guide members 41*a* of the needle bars 4 move along the first horizontal guideway 11, the neck 5*a* and the second horizontal guideway 12 during the horizontal motion of the needle bar mounting frame 3. When the guider 4*a* of a certain needle bar 4 is clamped into the neck 5*a* individually, the needle bar 4 may be driven by the needle bar driving block 5 to move up and down to further get into a working state.

The needle bar mounting frame 3 is provided with a vertical slideway, and the clamping column 41 is provided with a slider 41*b* in sliding fit with the slideway, in order to improve the stability of the needle bars 4 and prolong the service life thereof when they move up and down.

The bracket 2 is fixed with a guide rail 21 arranged horizontally, and the needle bar mounting frame 3 is connected to the slider 22 on the guide rail 21. The bracket 2 is fixedly provided with a driving mechanism for driving the needle bar mounting frame 3 to slide. The needle bar mounting frame 3 is driven by the driving mechanism 3 to move horizontally along the guide rail 21.

The driving mechanism comprises a cylinder unit 6 consisting of at least one cylinder. As the needle bar mounting frame 3 in this embodiment is provided with three needle bars 4, the needle bar mounting frame 3 requires three stroke positions to enable the corresponding needle bar 4 to be clamped into the neck 5*a* when the needle bar mounting frame 3 reaches one of the stroke positions.

In order to drive the needle bar mounting frame 3 to reach the three determined stroke positions, the driving mechanism in this embodiment comprises a first cylinder 61 and a second cylinder 62 connected to each other; and the driving rod of the first cylinder 61 is connected to the mounting plate 1 while the driving rod of the second cylinder 62 is connected to the needle bar mounting frame 3. The needle bar mounting frame 3 moves to the leftmost stroke position and the rightmost needle bar 4 is clamped into the neck 5*a*, when the driving rods of the first cylinder 61 and the second cylinder 62 are retracted into the cylinder bodies; when the needle bar mounting frame 3 moves to the middle stroke position and the middle needle bar 4 is clamped into the neck 5*a*, when the driving rod of one of the first cylinder 61 and the second cylinder 62 is retracted into the cylinder body while the other is extended out from the cylinder body; and, when the needle bar mounting frame 3 moves to the rightmost stroke position and the leftmost needle bar 4 is clamped into the neck 5*a*, when the driving rods of both the first cylinder 61 and the second cylinder 62 are extended out from the cylinder bodies.

When the machine stops to switch the needle bars 4, the needle bar driving block 5 stops at a preset height to locate the first horizontal guideway 11, the neck 5*a* and the second horizontal guideway 12 on a same horizontal plane. The driving mechanism drives the needle bar mounting frame 3 to move horizontally to enable each of the needle bars 4 to slide along the first horizontal guideway 11, the neck 5*a* and the second horizontal guideway 12. When the needle bar mounting frame 3 stops at a certain stroke position, the needle bar 4 corresponding to this stroke position is clamped into the neck 5*a* individually, and is in linkage with the upper shaft through the needle bar driving block 5 for sewing.

Second Embodiment

Figure 3:
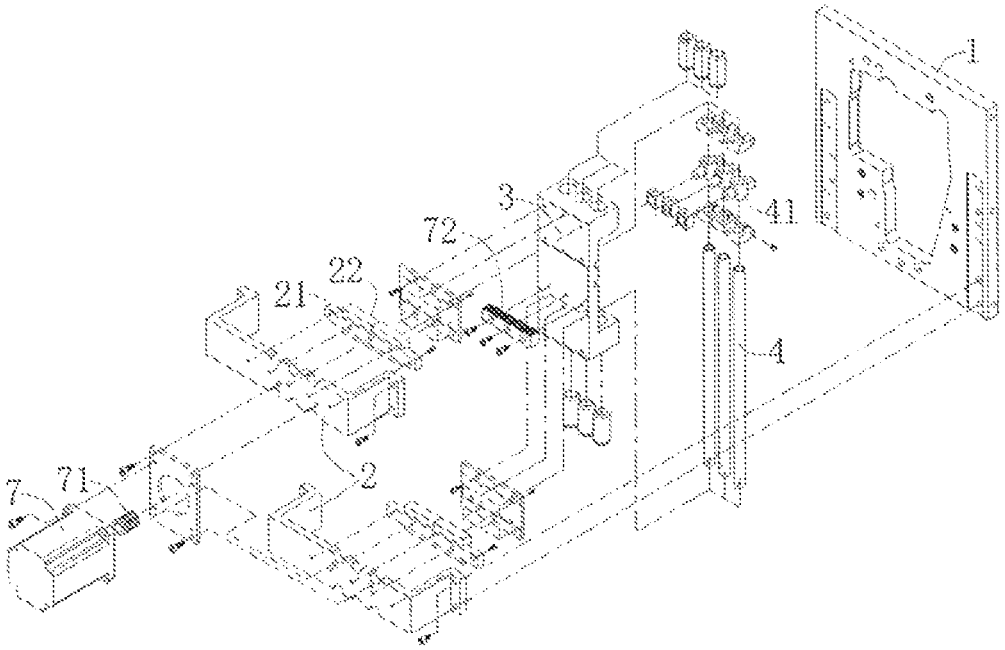
FIG. 3 is a stereoscopic structure diagram of the second embodiment according to the present invention.

The second embodiment improves the driving mechanism on the basis of the above embodiment. As shown in FIG. 3, the driving mechanism in this second embodiment comprises a motor 7, a gear 71 connected to the motor 7, and a rack 72 disposed on the needle bar mounting frame 3 and meshed with the gear 71. The needle bar mounting frame 3 may be controlled to move among the three stroke positions by controlling the rotation angle of the motor 7, so that a required needle bar 4 is selected to be clamped into the neck 5*a*. For the driving mechanism in this embodiment, the needle bar mounting frame 3 may be allowed to move between two or more stroke positions, thereby adapting to the different numbers of the needle bars.

Third Embodiment

The third embodiment reduces the number of the needle bars on the needle bar mounting frame 3 to two on the basis of the first embodiment. The driving mechanism may control the needle bar mounting frame 3 to move between two stroke positions just by one cylinder.

Fourth Embodiment

The fourth embodiment increases the number of the needle bars on the needle bar mounting frame 3 to four on the basis of the first embodiment. The driving mechanism may control the needle bar mounting frame 3 to move among four stroke positions by adopting a cylinder unit structure where three cylinders are linearly connected to each other, thus ensuring that, for each stroke position, a corresponding needle bar 4 may be selected to be individually clamped into and work inside the needle bar driving block 5.

The optimal embodiments of the present invention have been illustrated above. Various changes and modifications made by an ordinary person skilled in the art shall not depart from the protection scope of the present invention.

The invention claimed is:

1. A multi-needle bar module for sewing machines, comprising a mounting plate adapted to a front end of a sewing machine head, characterized in that the mounting plate is equipped in a sliding manner, via a bracket, with a needle bar mounting frame on which at least two needle bars are distributed at intervals, the needle bars being in axial sliding fit with the needle bar mounting frame;

the mounting plate is provided with a U-shaped first horizontal guideway and a U-shaped second horizontal guideway disposed at intervals and spaced apart, and a needle bar driving block with a neck is disposed between the first horizontal guideway and the second horizontal guideway; the needle bars are provided with guide members that can be clamped into the first horizontal guideway and the second horizontal guideway; the needle bar mounting frame clamps, by sliding horizontally, the guide of any one of the needle bars individually into the neck;

wherein the U-shaped first horizontal guideway and the U-shaped second horizontal guideway are positioned in a same plane such that sectional areas of the first horizontal guideway and the second horizontal guideway along the same plane are respectively in a U-shape, two free ends of two parallel arms of the U-shaped first horizontal guideway point to and are aligned with two free ends of two parallel arms of the U-shaped second horizontal guideway, respectively; a cuboid-shaped opening between the two parallel arms of the U-shaped first horizontal guideway and a cuboid-shaped opening between the two parallel arms of the second horizontal guideway oppose and are aligned with each other, the needle bar driving block with the neck is vertical to the same plane of the U-shaped first and second horizontal guideways; and the two free ends of the two parallel arms of the U-shaped first horizontal guideway are not connected with the two free ends of the two parallel arms of the U-shaped second horizontal guideway.

2. The multi-needle bar module according to claim 1, wherein the bracket is fixedly provided with a driving mechanism for driving the needle bar mounting frame to slide, and wherein the driving mechanism comprises a cylinder unit comprising at least one cylinder, and the driving rod of the cylinder is connected to the needle bar mounting frame.

3. The multi-needle-bar module according to claim 1, wherein the bracket is fixedly provided with a driving mechanism for driving the needle bar mounting frame to slide, and wherein the driving mechanism comprises a motor, a gear connected to the motor, and a rack disposed on the needle bar mounting frame and meshed with the gear.

4. The multi-needle bar module according to claim 2, characterized in that the needle bar mounting frame is provided with three needle bars distributed at intervals, and the cylinder unit consists of two cylinders connected to each other.

5. A multi-needle bar module for sewing machines, comprising a mounting plate adapted to a front end of a sewing machine head, characterized in that the mounting plate is equipped in a sliding manner, via a bracket, with a needle bar mounting frame on which at least two needle bars are distributed at intervals, the needle bars being in axial sliding fit with the needle bar mounting frame;

the mounting plate is provided with a U-shaped first horizontal guideway and a U-shaped second horizontal guideway disposed at intervals and spaced apart, and a needle bar driving block with a neck is disposed between the first horizontal guideway and the second horizontal guideway; the needle bars are provided with guide members that can be clamped into the first horizontal guideway and the second horizontal guideway; the needle bar mounting frame clamps, by sliding horizontally, the guide of any one of the needle bars individually into the neck;

wherein the U-shaped first horizontal guideway and the U-shaped second horizontal guideway are positioned in a same plane such that sectional areas of the first horizontal guideway and the second horizontal guideway along the same plane are respectively in a U-shape, two free ends of two parallel arms of the U-shaped first horizontal guideway point to and are aligned with two free ends of two parallel arms of the U-shaped second horizontal guideway, respectively; a cuboid-shaped opening between the two parallel arms of the U-shaped first horizontal guideway and a cuboid-shaped opening between the two parallel arms of the second horizontal guideway oppose and are aligned with each other, the needle bar driving block with the neck is vertical to the same plane of the U-shaped first and second horizontal guideways;

the two free ends of the two parallel arms of the U-shaped first horizontal guideway are not connected with the two free ends of the two parallel arms of the U-shaped second horizontal guideway;

wherein the needle bar driving block is disposed on a vertical guide shaft in a sliding manner;

wherein the needle bars are fixedly connected with a clamping column on which the guide members are located;

wherein the needle bar mounting frame is provided with a vertical slideway, and the clamping column is provided with a slider in sliding fit with the slideway;

wherein a first guide and a second guide are fixed on the mounting plate at intervals, and the U-shaped first horizontal guideway is located on the first guide while the U-shaped second horizontal guideway is located on the second guide;

wherein the bracket is fixed with a guide rail arranged horizontally, and the needle bar mounting frame is connected to a slider on the guide rail;

wherein the bracket is fixedly provided with a driving mechanism for driving the needle bar mounting frame to slide;

wherein the driving mechanism comprises a cylinder unit consisting of two cylinders, and the driving rod of the cylinder is connected to the needle bar mounting frame;

wherein the driving mechanism comprises a motor, a gear connected to the motor, and a rack disposed on the needle bar mounting frame and meshed with the gear; and wherein the needle bar mounting frame is provided with three needle bars distributed at intervals.

6. The multi-needle bar module according to claim 1, wherein the needle bar driving block is disposed on a vertical guide shaft in a sliding manner.

7. The multi-needle-bar module according to claim 6, wherein the needle bars are fixedly connected with a clamping column on which the guide members are located.

8. The multi-needle bar module according to claim 7, wherein the needle bar mounting frame is provided with a vertical slideway, and the clamping column is provided with a slider in sliding fit with the slideway.

9. The multi-needle bar module according to claim 1, wherein a first guide and a second guide are fixed on the mounting plate at intervals, and the first horizontal guideway is located on the first guide while the second horizontal guideway is located on the second guide.

10. The multi-needle bar module according to claim 9, wherein the bracket is fixed with a guide rail arranged horizontally, and the needle bar mounting frame is connected to the slider on the guide rail.

11. The multi-needle bar module according to claim 10, wherein the bracket is fixedly provided with a driving mechanism for driving the needle bar mounting frame to slide.

* * * * *